US007166001B2

(12) United States Patent
Detter et al.

(10) Patent No.: US 7,166,001 B2
(45) Date of Patent: Jan. 23, 2007

(54) AXIALLY ACTUATED BATTERY TERMINAL POST CLAMP

(75) Inventors: Gary C. Detter, Berlin Center, OH (US); Jay Harold Garretson, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/019,041

(22) Filed: Dec. 21, 2004

(65) Prior Publication Data

US 2006/0135000 A1 Jun. 22, 2006

(51) Int. Cl.
*H01R 4/42* (2006.01)

(52) U.S. Cl. ..... 439/762

(58) Field of Classification Search ..... 439/762, 439/867

See application file for complete search history.

(56) References Cited

U.S. PATENT DOCUMENTS

| | | | | |
|---|---|---|---|---|
| 5,302,143 | A | 4/1994 | Inoue et al. | |
| 5,492,780 | A * | 2/1996 | Okada | 429/121 |
| 5,547,403 | A | 8/1996 | Haberstroh et al. | |
| 5,558,544 | A * | 9/1996 | Okada et al. | 439/762 |
| 5,558,545 | A * | 9/1996 | Staab et al. | 439/762 |
| 5,595,511 | A | 1/1997 | Okada | |
| 5,851,129 | A * | 12/1998 | Matsunaga et al. | 439/764 |
| 5,879,202 | A * | 3/1999 | Zhao | 439/762 |
| 5,934,947 | A * | 8/1999 | Liang | 439/762 |
| 5,941,738 | A * | 8/1999 | Matsunaga et al. | 439/762 |
| 6,561,855 | B1 * | 5/2003 | Cret | 439/762 |
| 2004/0087219 | A1 | 5/2004 | Freitag | |

FOREIGN PATENT DOCUMENTS

| | | |
|---|---|---|
| DE | 297 07 773 | 6/1997 |
| EP | 0 615 311 | 9/1994 |
| EP | 0 653 806 | 5/1995 |

OTHER PUBLICATIONS

European Search Report dated Apr. 4, 2006.

* cited by examiner

*Primary Examiner*—Tulsidas C. Patel
*Assistant Examiner*—Harshad C Patel
(74) *Attorney, Agent, or Firm*—David P. Wood

(57) ABSTRACT

An axially actuated battery terminal post clamp in which a threaded fastener causes clamping action of a concave post seat onto the convex surface of a battery terminal post, and wherein the threaded fastener is oriented axially, that is, substantially parallel to the longitudinal axis of the battery terminal post. A clamp body has a concave post seat defining a post seat axis, a first sidewall member and a second sidewall member. First and second U-shaped clips are interfaced with the first and second sidewall members and have guide holes, wherein at least one clip has tapered guide holes. A threaded fastener is oriented parallel to the post seat axis and has tapers which interact with the guide holes to cause the diameter of the post seat to decrease as the threaded fastener is actuated.

18 Claims, 5 Drawing Sheets

AXIALLY ACTUATED BATTERY TERMINAL POST CLAMP

TECHNICAL FIELD

The present invention relates to electrical connection clamps used to connect wiring to terminal posts of an automotive battery. More particularly, the present invention relates to a battery terminal post clamp which is axially actuated.

BACKGROUND OF THE INVENTION

Automotive batteries, particularly lead-acid batteries used for automotive applications, have a pair of elongated (i.e., cylindrical) terminal posts, one positive, the other negative, for connecting to external wiring. Conventionally, a positive lead wire and a negative lead wire are each provided with a respective clamp having a concave engagement seat which seats onto the elongated, convex surface of the terminal posts. A threaded fastener, most commonly a bolt and nut combination, is oriented transversely relative to the longitudinal axis of the terminal post (i.e., parallel to the surface of the battery from which the post extends), and is tightened to compress the clamp around or against the terminal post to thereby provide a good mechanical and electrical connection between the terminal post and the lead wire.

FIGS. 1A and 1B depict an operational example of a transversely-actuated, prior art battery terminal post clamp of the type referred to above. The battery 10 has a battery surface 12, wherein a pair of battery terminal posts 14 (one positive, the other negative, only one of which being shown) extend substantially perpendicular to the external surface of the battery. The terminal post 14 has an elongated, convex surface 14*s*. A lead wire 16 has a prior art battery post terminal clamp 18 attached to the end thereof. The battery terminal post clamp 18 has a concave post seat 20 defining a post seat axis Ax, and further has first and second planar extensions 22, 24 at either end of the post seat. The first planar extension 22 is connected with a wire crimp feature 26, and has a bolt hole 28 formed therein. The second planar extension 24 has a nut receptacle 30 which retains a nut 32 thereat. A bolt 34 passes through the bolt hole 28 and threadably engages the nut 32. It is understood, therefore, that the threaded fastener 35 (the bolt-nut combination) is oriented transversely with respect to the longitudinal axis Ap of the terminal post 14 and to the axis Ax of the post seat 20, along a threading actuation axis Ac. By tightening the bolt onto the nut, the first and second planar extensions are caused to come closer to each other, thereby resulting in the concave post seat 20 tightly engirding (at nibs 20*b*) the convex surface of the terminal post in an electrically and mechanically effective manner.

Problematically, the actuation of the bolt when in the transverse attitude as shown at FIGS. 1A and 1B can be difficult. This difficulty arises because an actuation tool (as for example a wrench or socket) must engage the head of the bolt and then be turned in order to actuate the battery terminal post clamp, yet structures in the vicinity may limit this from happening. For example, the battery may have its vent/fill caps near to the location needed for placement/and or movement of the actuation tool, or the battery may be located such that an external structure inhibits the actuation tool from placement and/or movement.

Accordingly, what remains needed in the art is some way in which a battery terminal post clamp can effectively engage a battery terminal post without transverse actuation.

SUMMARY OF THE INVENTION

The present invention is an axially actuated battery terminal post clamp in which a threaded fastener causes clamping action of a concave post seat onto the convex surface of a battery terminal post, and wherein the threaded fastener is oriented axially (i.e., along an axis that lies substantially parallel to the axis of the battery terminal post).

The axially actuated battery terminal post clamp according to the present invention includes a clamp body having a concave post seat defining a post seat axis, a first sidewall member connected to one end of the clamp concave post seat, a second sidewall member connected to the other end of the concave post seat, wherein at least one of the first and second sidewall members carries a nut receptacle and an electrical lead connection feature; a nut received in the nut receptacle; a first clip associated with the first sidewall member, and a second clip associated with the second sidewall member, wherein the first and second clips are provided with guide holes axially aligned with respect to a threaded hole of the nut, and wherein the guide holes of at least one of the first and second clips is tapered (the other clip may have round or tapered guide holes); and a bolt for passing through the guide holes and threadably engaging the nut, wherein the bolt has a frustoconical bolt taper and the nut has a frustoconical nut taper which abuttingly interface with the guide holes so as to cause the first and second sidewall members to be drawn together in a direction perpendicular to the post axis as the bolt and nut are actuated by being threadably tightened.

It is preferable for the first and second clips to be U-shaped, defining upper and lower lateral clip walls separated by an axial clip wall. It is further preferable for the first and second sidewall members to be slotted for receiving the lower lateral clip wall of its respective first and second clip.

In operation, the concave post seat is placed over (that is, around the external, often cylindrical, surface of) a battery terminal post. Next, the bolt, which is oriented axially, that is, substantially parallel to the post seat axis and to the longitudinal axis of the battery terminal post, is actuated by being rotated so as to threadably tighten the bolt with respect to the nut. As the tightening ensues, the bolt taper of the bolt engages the guide holes of the upper lateral clip wall of each of the first and second clips, and the nut taper of the nut engages the guide holes of the lower lateral clip wall of each of the first and second clips. In this regard, the frustoconical tapers of the bolt and the nut engage the tapers of the guide holes (the guide hole tapers being in a plane perpendicular to the post seat axis), causing the first and second sidewall members to move closer together in the plane perpendicular to the post seat axis as the progressively increasing diameters of the tapers of the bolt and the nut seek a wider portion of the tapers of the tapered guide holes. As the first and second sidewall members move closer together, the concave post seat closes around the battery terminal post, eventually coming into a very tight mechanical and good electrical interconnection therewith. In this regard the interconnection is preferably enhanced by a plurality (as for example six) of radially inward directed teeth of the concave post seat.

Accordingly, it is an object of the present invention to provide an axially actuated battery terminal post clamp for providing a tight mechanical and good electrical interconnection with a terminal post of a battery.

This and additional objects, features and advantages of the present invention will become clearer from the following specification of a preferred embodiment.

BRIEF DESCRIPTION OF THE DRAWINGS

FIGS. 5A and 5B depict an initial stage of clamping operation of the axially actuated battery terminal post clamp of FIG. 2, wherein FIG. 5A is a top plan view and FIG. 5B is a sectional end view.

FIGS. 6A and 6B depict a final stage of clamping operation of the axially actuated battery terminal post clamp of FIG. 2, wherein FIG. 6A is a top plan view and FIG. 6B is a sectional end view.

DESCRIPTION OF THE PREFERRED EMBODIMENT

Figure 1A:
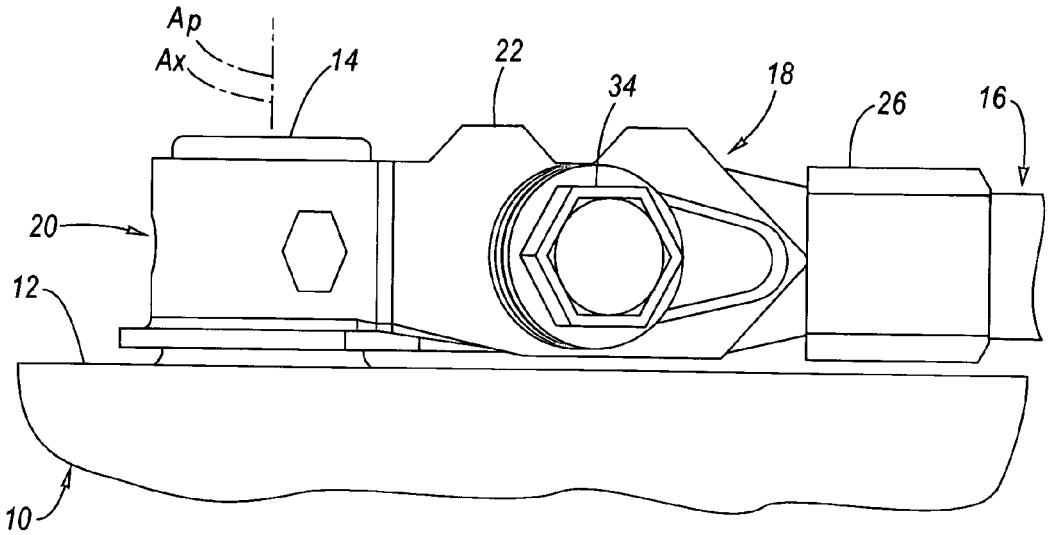
Prior Art Fig. 1A
FIGS. 1A and 1B are views of a prior art transversely (i.e., horizontally where the battery post extends vertically) actuated battery terminal post clamp, shown in operation with respect to a battery.
Figure 1B:
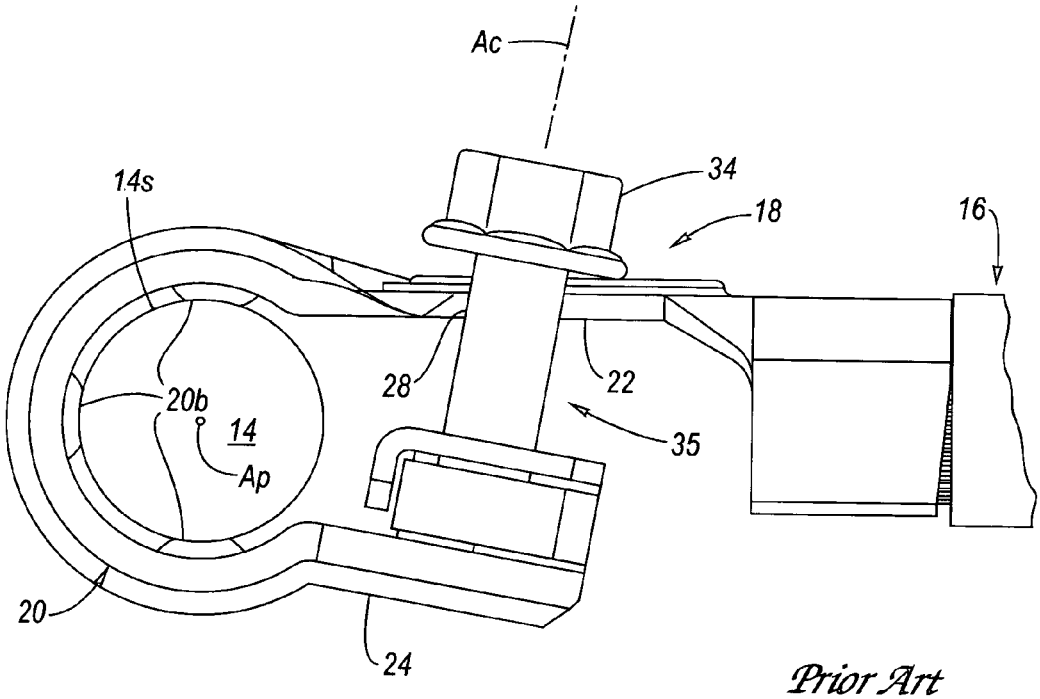
Prior Art Fig. 1B

Referring now to the Drawing, FIGS. 2 through 8B depict various aspects of an example of an axially actuated battery terminal post clamp according to the present invention.

Turning attention firstly to FIGS. 2 through 7B, structural aspects of a preferred axially actuated battery terminal post clamp 100 will be detailed.

In an exemplary embodiment, an axially actuated battery terminal post clamp 100 includes a clamp body 102 having three integrally connected constituents: a concave post seat 104 defining a post seat axis Ax', a first sidewall member 106 connected to one end of the concave post seat, and a second sidewall member 108 connected to another end of the concave post seat. A radially outward flared lip 115 is preferably provided at a bottom end of the clamp body. Either one of the first and second sidewall members carries a nut receptacle 110, and additionally, either one of the first and second sidewall members carries an electrical lead connection feature 112 preferably including a lead sheath crimp feature 112*a* and a lead wire crimp feature 112*b*, wherein the first sidewall member 106 is shown by way of example in the drawing as carrying both the nut receptacle and the electrical lead connection feature. Each of the first and second sidewall members 106, 108 is provided with a respective slot 106*s*, 108*s*, as best shown at FIG. 4.

A nut 114 has a main nut body 114*a* and a frustoconical nut taper 114*b* integrally connected with the main nut body concentrically disposed with respect to the threading axis T of the nut. The nut taper 114*b* tapers parallel to the threading axis T and is characterized by a maximum diameter adjoining the main nut body 114*a* with progressively decreasing diameter with increasing distance therefrom. The main nut body 114*a* is seated into the nut receptacle 110 such that it is supported by a floor 110*a*, but is free to move parallel to the threading axis T, and is prevented from turning relative to the clamp body 102 by abutments 110*b*, wherein, when seated, the nut taper 114*b* is oppositely disposed relative to the floor.

Figure 4:
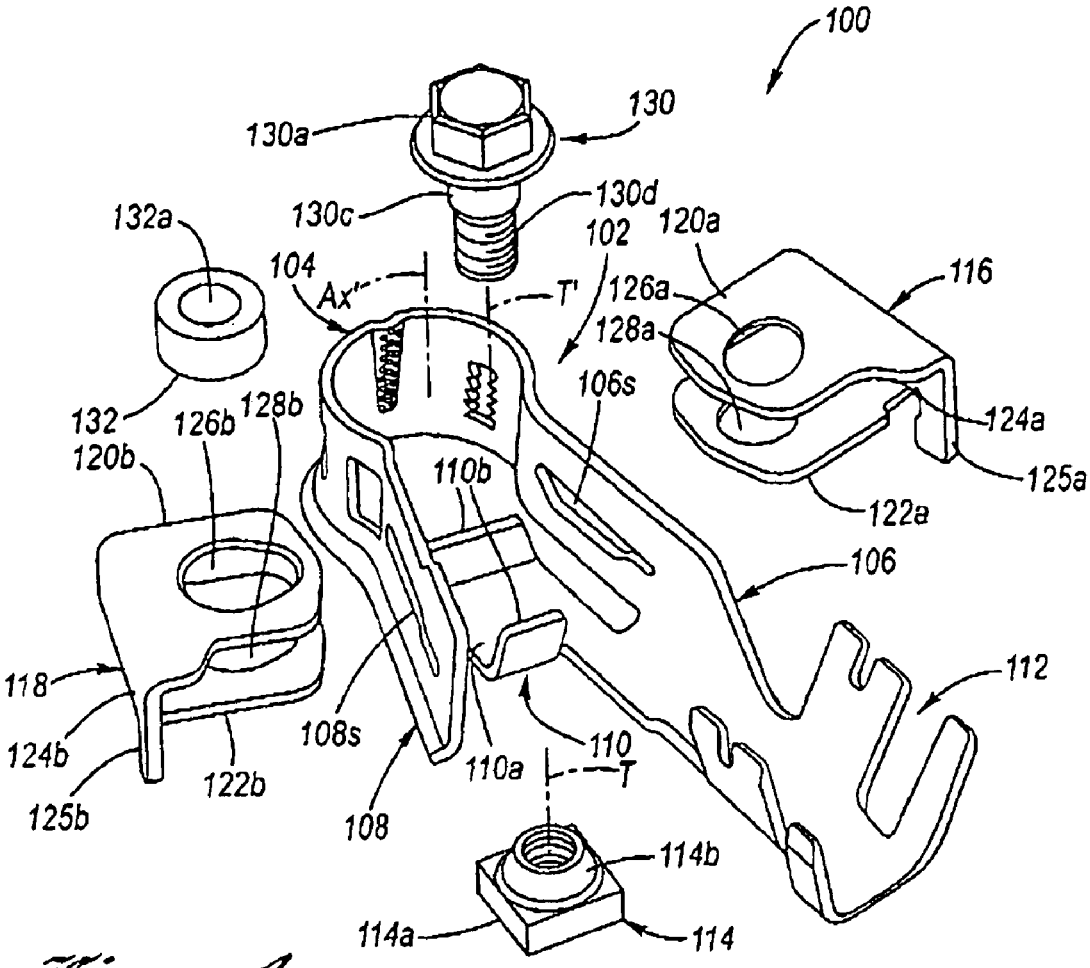
FIG. 4 is an exploded, perspective view of the axially actuated battery terminal post clamp of FIG. 2.

As shown at FIG. 4, an axially actuated battery terminal post clamp 100 has a pair of U-shaped first and second clips 116, 118, each respectively having an upper lateral clip wall 120*a*, 120*b*, a lower lateral clip wall 122*a*, 122*b*, and an end clip wall 124*a*, 124*b* which is integrally connected with, and oriented perpendicular to, the respective upper and lower lateral clip walls. Each of the upper and lower lateral clip walls 120*a*, 122*a* of the first clip 116 have a round guide hole 126*a*, 128*a*. Each of the upper and lower lateral clip walls 120*b*, 122*b* of the second clip 118 have a tapered guide hole 126*b*, 128*b*, wherein the taper is in a plane perpendicular to the post seat axis Ax' and is characterized by a wider diameter disposed adjacent the end clip wall 124*b* which progressively decreases with distance therefrom. The length of the end clip wall 124*a*, of the first clip 116 is different from the length of the end clip wall 124*b* of the second clip 118 such that the upper and lower lateral clip walls of the first and second clips are mutually nestable, wherein, when nested, the guide holes are aligned with each other. In this regard for the aforesaid preferred structural configuration, the manner of the nesting is for first clip 116 to nest within the second clip 118, as shown at FIGS. 5B and 6B. Each of the first and second clips 116, 118 preferably has a downwardly projecting leg 125*a*, 125*b* connected with its respective end clip wall 124*a*, 124*b*.

Figure 4A:
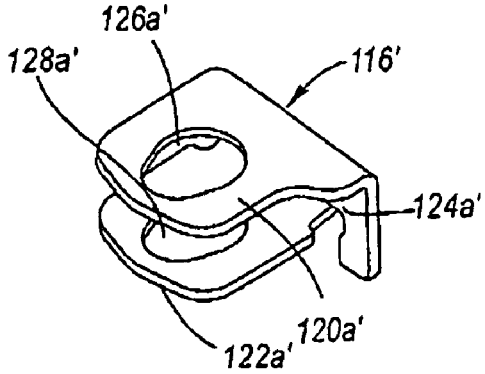
FIG. 4A is a perspective view of a modified first clip of the axially actuated battery terminal post clamp seen at FIG. 4.

As shown at FIG. 4A, a modified first clip 116' may be alternatively provided, wherein now the upper and lower lateral clip walls 120*a*', 122*a*' have tapered guide holes 126*a*', 128*a*' wherein the taper is characterized by a wider diameter disposed adjacent the end clip wall 124*a*' which progressively decreases with distance therefrom. The modified first clip 116' is nestable with the second clip 118 as described hereinabove, wherein the nesting may be in any manner.

A bolt 130 is provided, having a drive head 130*a* which includes an annular base, a frustoconical bolt taper 130*b* adjacent the drive head (see in particular FIGS. 5B and 6B), an unthreaded shank portion 130*c*, and a threaded portion 130*d* for being threadably engaged with the nut 114. The bolt taper 130*b* tapers parallel to the threading axis T' of the bolt and is characterized by a maximum diameter adjoining the drive head 130*a* with progressively decreasing diameter with increasing distance therefrom. When the bolt 130 is threadably engaged with the nut 114, an actuation axis Ac' of the threaded fastener 135 (composed collectively of the bolt and the nut) is parallel to both the thread axis T' of the bolt and the thread axis T of the nut (see FIG. 2).

A spacer 132 is provided, which may be of plastic (all other components of the axially actuated battery terminal post clamp being of conductive material, e.g., metal). The spacer has a hole 132*a* therethrough which allows the shank and threaded portions of the bolt 130 to pass therethrough. The width of the spacer is selected to generally match the spacing between the upper and lower lateral clip walls 120*a*, 120*b*, 122*a*, 122*b* when in the aforementioned mutually nested state so as to maintain the spacing therebetween when the bolt 130 is actuated by being threadably tightened with respect to the nut 114.

Figure 7A:
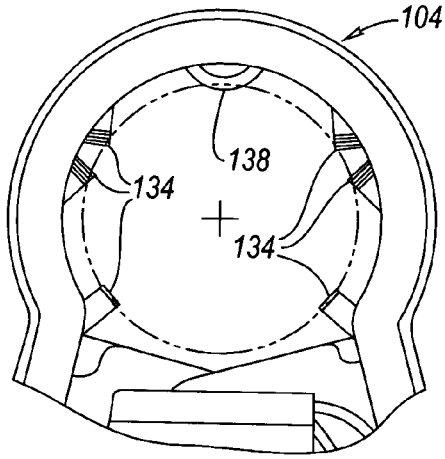
FIGS. 7A and 7B depict detail, bottom plan views of concave post seats for positive and negative terminal posts, respectively, of an axially actuated battery terminal post clamp according to an exemplary embodiment of the present invention.
Figure 7B:
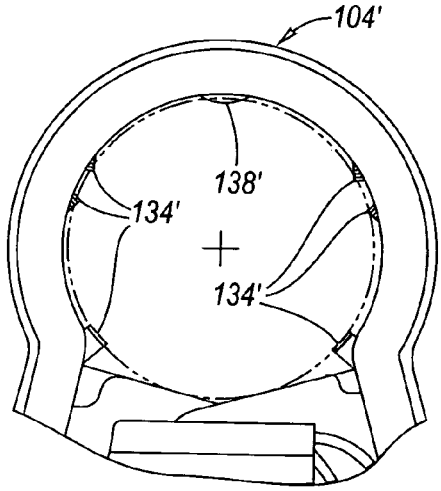

As shown in detail at FIG. 7A, the concave post seat 104, preferably has a plurality (six being shown in the figures) of radially inward directed teeth 134, formed (as for example by stamping) along at least one side of a generally rectangular opening 136 (see FIGS. 2 and 3) in the concave post seat. A centrally disposed post engagement dimple 138 is also preferably provided having increasing radially inward draft with increasing distance from the bottom lip 115. In those applications where the battery terminal posts are of different diameters as between the negative and the positive terminals, it is preferred for the concave post seat to be commensurately sized with commensurately sized teeth and dimple. An example thereof is shown comparatively at FIGS. 7A and 7B, wherein a negative terminal is shown in phantom at FIG. 7A and a larger diameter positive terminal is shown in phantom at FIG. 7B (numerals with primes designating like parts of the same numerals in FIG. 7A).

Assembly of an axially actuated battery terminal post clamp 100 will now be discussed.

The nut 114 is seated into the nut receptacle 110. Next the lower lateral clip wall 122*b* of the second clip 118 is passed through the slot 108*s* of the second sidewall member 108, thus trapping the nut at the nut receptacle. Then the lower lateral clip wall 122*a* of the first clip 116 is passed through the slot 106*s* of the first sidewall member 106, whereupon the upper and lower lateral clip walls are mutually nested and the guide holes thereof are mutually aligned and also aligned with the threading axis T of the nut. In this regard, it is preferred for the slots to be dimensionally different or positionally different on their respective first and second sidewall members in concert with dimensional differences of the first and second clips so as to uniquely index them with respect to the left and right sidewalls (the legs 125*a*, 125*b* providing a visual indication for insertion orientation). The spacer 132 is then placed into the space between the upper and lower lateral clip walls so that the hole 132*a* thereof is aligned with the guide holes. The threaded portion of the bolt is then passed through the guide holes and the spacer hole so as to be threadably engaged with the nut.

Figure 2:
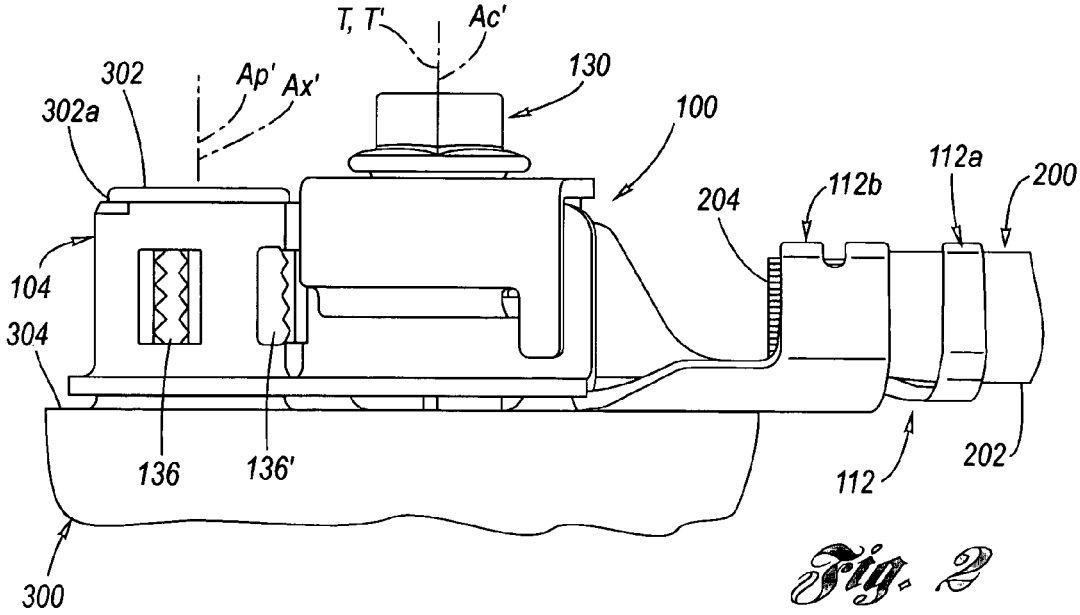
FIG. 2 is a side view end view of an axially (i.e., parallel) actuated battery terminal post clamp according to an exemplary embodiment of the present invention, shown in operation with respect to an electrical lead and a battery.
Figure 3:
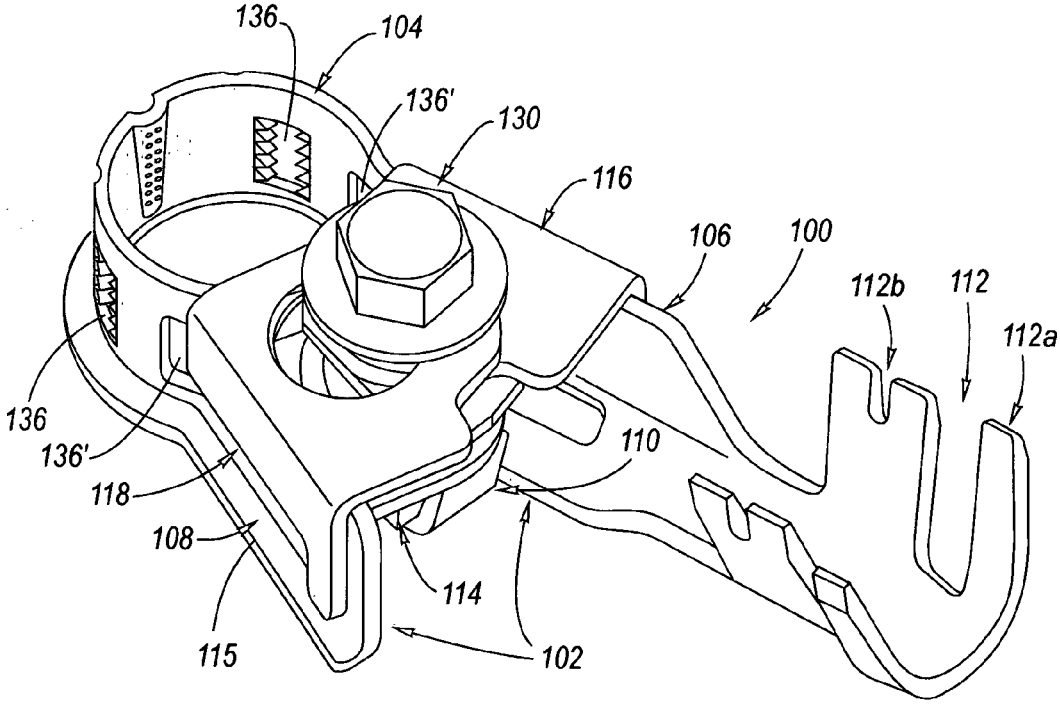
FIG. 3 is a perspective view of the axially actuated battery terminal post clamp of FIG. 2.

Referring now mainly to FIG. 2 and additionally to FIGS. 5A through 6B, operation of an axially actuated battery terminal post clamp 100 will be detailed.

As shown at FIG. 2, an axially actuated battery terminal post clamp 100 is connected with an electrical lead 200 via the electrical lead connection feature 112, wherein the lead sheath crimp feature 112*a* is crimped over the sheath 102 of the lead and wherein the wire crimp feature 112*b* is crimped on the wire 204 of the lead. A battery 300 has a terminal post 302 extending from a battery surface 304, in a direction substantially perpendicular to the battery surface 304. In this case, the terminal post 302 has an elongated, cylindrical surface 302*a*. The mating cylindrical post seat 104 is placed over the terminal post (that is, disposed in engirding relation to the elongated, cylindrical surface of the terminal post). It will be seen from FIG. 2 that now the threaded fastener 135 has mutually parallel threading axes T, T' and an actuation axis Ac', and these axes are all oriented substantially parallel to the longitudinal axis Ap' of the battery terminal post 302 and to the post seat axis Ax' (i.e., oriented axially, substantially parallel to the longitudinal axis the battery terminal post).

Figure 5A:
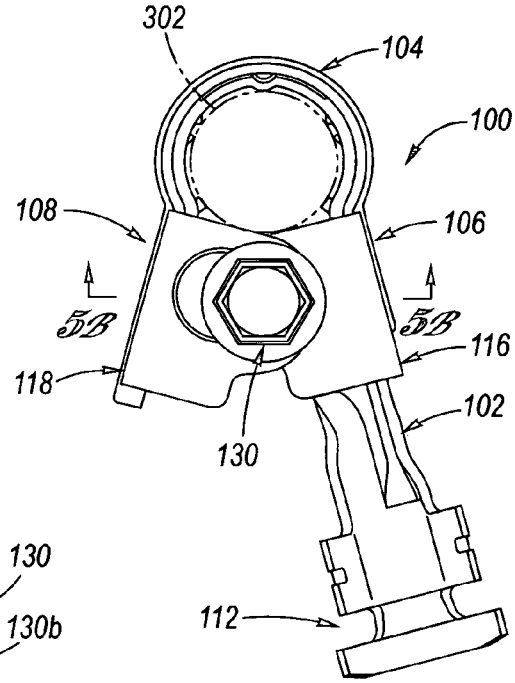
Figure 5B:
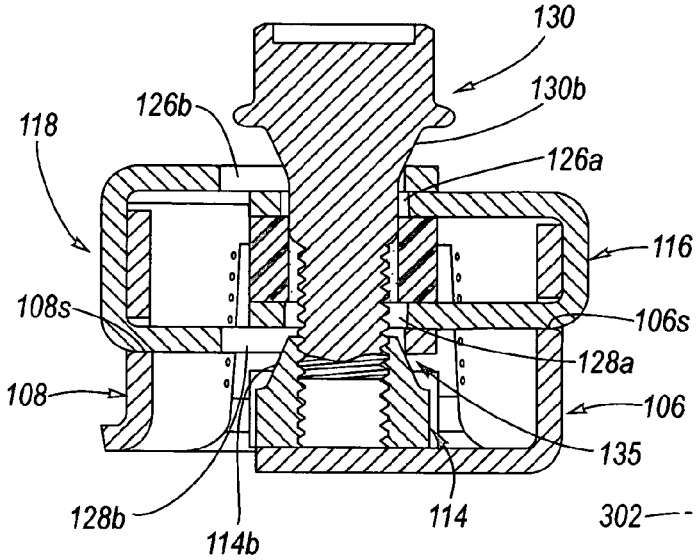

As shown at FIGS. 5A and 5B, after placement of the concave post receptacle upon the battery terminal post, actuation of the threaded fastener 135 is accomplished by the bolt 130 being rotated relative to the nut 114 so as to threadably tighten the bolt with respect to the nut. As the tightening of the threaded fastener ensues, the bolt taper 130*b* of the bolt engages the guide holes of the upper lateral clip walls of each of the first and second clips; simultaneously, the nut taper 114*b* of the nut engages the guide holes of the lower lateral clip walls of the first and second clips.

Figure 6A:
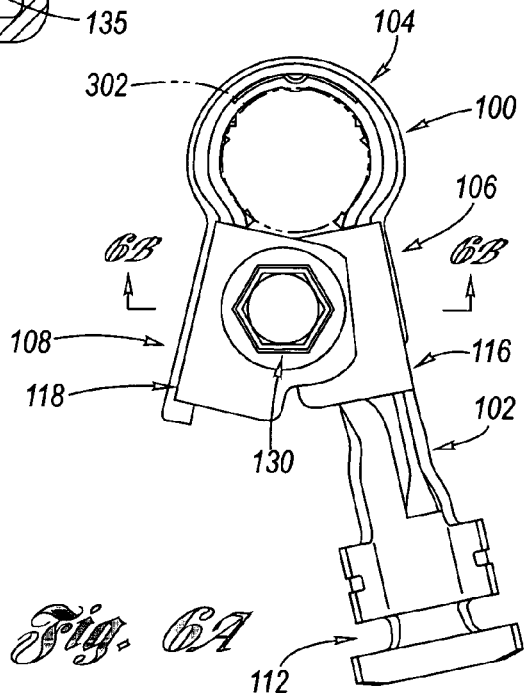
Figure 6B:
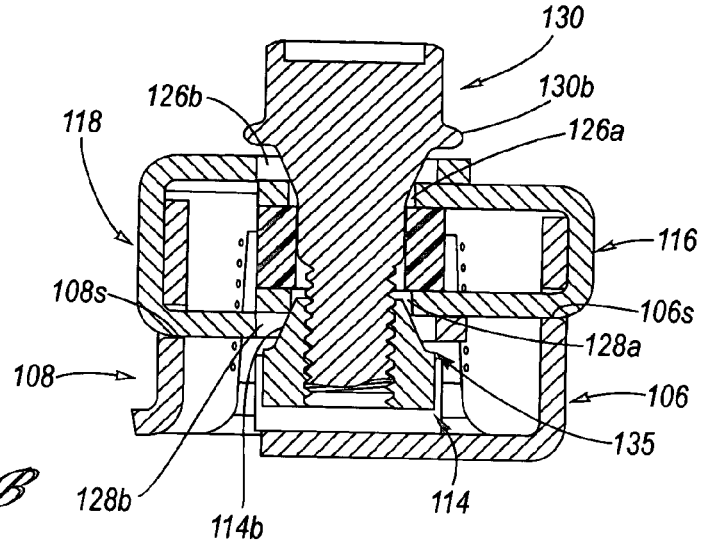

The size and the rate of taper of the guide holes is predetermined with respect to the size and rate of taper of the bolt and nut tapers such as to cause increasing diameters of the bolt and nut tapers to seek increasing diameters of the tapered guide holes. As shown at FIGS. 6A and 6B, as the bolt and nut tapers of the bolt and the nut, respectively, move increasingly further along the actuation and threading axes Ac', T, T' into the guide holes, the tapered guide holes are forced to laterally move perpendicularly to the actuation and threading axes as the progressively increasing diameters of the bolt and nut tapers seek increasing diameters of the tapers of the tapered guide holes, thereby causing the first and second sidewall members to move closer together in a plane perpendicular to the post seat axis Ax' and consequently causing the concave post seat to assume a smaller diameter which results in the post seat 104 clamping onto the battery terminal post. When the bolt has tightly threaded onto the nut, as shown at FIG. 6B, the first and second sidewall members have moved closer together and the concave post seat is closed tightly around the battery terminal post, having a very tight mechanical and good electrical interconnection therewith.

Figure 8A:
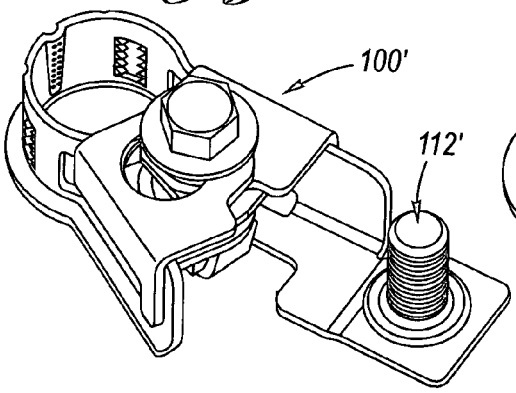
FIGS. 8A and 8B depict alternative embodiments of axially actuated battery terminal post clamps according to the present invention.
Figure 8B:
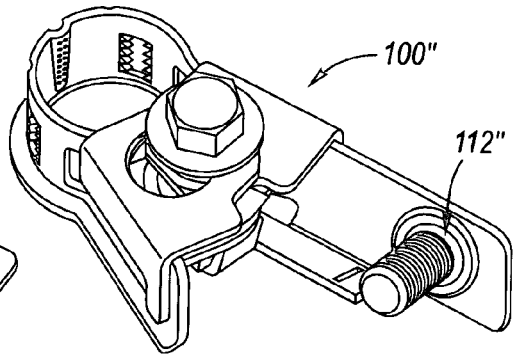

FIGS. 8A and 8B depict examples of alternative embodiments of axially actuated battery terminal post clamps 100', 100" having structural aspects as described hereinabove, wherein now modified electrical lead connection features 112', 112" are provided. An electrical lead (not shown) is attached thereto via threaded studs 112*c'*, 112*c"* connected to one of the left and right sidewalls. In this regard, for example the electrical lead would have an eyelet which slips onto the threaded stud and is the electrically and mechanically secured thereto by a nut threading thereover onto the stud. Alternatively, rather than provide studs, attachment holes may be provided for receiving therethrough a threaded fastener onto which an eyelet of the electrical lead my be connected.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. An axially actuated battery terminal post clamp, comprising:

a clamp body comprising a concave post seat having a diameter, a first end and a second end, wherein said concave post seat defines a post seat axis; and a threaded fastener connected with said clamp body, said threaded fastener being orientated parallel to said post seat axis;

wherein said clamp body further comprises:

a first sidewall member integrally connected to said first end of said concave post seat; and a second sidewall member integrally connected to said second end of said concave post seat;

wherein each of said first and second sidewalls has at least one tapered guide hole interfaced therewith;

wherein said threaded fastener has at least one frustoconical taper, said threaded fastener passing through said at least one tapered guide hole; and wherein as said threaded fastener is actuated by being threadably tightened, said at least one frustoconical taper thereof engages said at least one tapered guide hole so as to thereby draw closer together said first and second sidewall members in a plane perpendicular to said post seat axis such that said diameter is decreased.

2. An axially actuated battery terminal post clamp, comprising:

a clamp body comprising a concave post seat having a diameter, a first end and a second end, wherein said concave post seat defines a post seat axis;

a threaded fastener connected with said clamp body, said threaded fastener being orientated parallel to said post seat axis; and a U-shaped first clip and a U-shaped second clip; said first clip associated with said first end of said post seat, and said second clip associated with said second end of said post seat; each of said first and second clips being respectively comprised of an upper lateral clip wall, a lower lateral clip wall, and an end clip wall integrally connected with said upper and lower lateral clip walls; each of said first and second lateral clip walls of said first and second clips having a guide hole; and a spacer located between said upper and lower lateral clip walls of said first and second clips;

wherein said threaded fastener has at least one frustoconical taper, said threaded fastener passing through each said guide hole;

wherein the guide hole of at least one of said upper and lower lateral clip walls of at least one of said first and second clips is tapered such that as said threaded fastener is actuated by being threadably tightened, said at least one frustoconical taper thereof engages each said guide hole so as to thereby decrease the diameter of said concave post seat.

3. The axially actuated battery terminal post clamp of claim 2, wherein said clamp body further comprises a nut receptacle connected with said clamp body; and wherein said threaded fastener comprises:

a bolt comprising a head, a frustoconical bolt taper adjacent said head and a threaded portion; and a nut comprising a main nut body and a frustoconical nut taper, said nut main body being selectively seated at said nut receptacle;

wherein as said threaded fastener is actuated by being threadably tightened, said bolt taper engages said at least one tapered guide hole of at least one of said upper lateral clip walls, and said nut taper engages said at least one tapered guide hole of at least one of said lower lateral clip walls, thereby collectively causing said first and second sidewall members to be drawn closer together in a plane perpendicular to said post seat axis such that said diameter is decreased.

4. The axially actuated battery terminal post clamp of claim 2, further comprising an electrical lead connection feature connected to said clamp body.

5. The axially actuated battery terminal post clamp of claim 2, further comprising a plurality of teeth formed at said post seat, said teeth having an inward radial orientation.

6. The axially actuated battery terminal post clamp of claim 2, wherein each said guide hole of each of said upper and lower lateral clip walls of first and second clips is tapered.

7. The axially actuated battery terminal post clamp of claim 6, wherein said clamp body further comprises a nut receptacle connected with said clamp body; and wherein said threaded fastener comprises:

a bolt comprising a head, a frustoconical bolt taper adjacent said head and a threaded portion;

a nut comprising a main nut body and a frustoconical nut taper, said nut main body being selectively seated at said nut receptacle; and a spacer located between said upper and lower lateral clip walls of said first and second clips;

wherein as said threaded fastener is actuated by being threadably tightened, said bolt taper engages each said tapered guide hole of each of said upper lateral clip walls, and said nut taper engages said tapered guide hole of each of said lower lateral clip walls, thereby collectively causing said first and second sidewall members to be drawn closer together in a plane perpendicular to said post seat axis such that said diameter is decreased.

8. The axially actuated battery terminal post clamp of claim 7, further comprising an electrical lead connection feature connected to said clamp body.

9. The axially actuated battery terminal post clamp of claim 7, further comprising a plurality of teeth formed at said post seat, said teeth having an inward radial orientation.

10. An axially actuated battery terminal post clamp, comprising:

a clamp body comprising:

a concave post seat having a diameter, a first end and a second end, wherein said concave post seat defines a post seat axis;

a first sidewall member integrally connected to said first end of said concave post seat; and a second sidewall member integrally connected to said second end of said concave post seat;

wherein each of said first and second sidewalls has at least one tapered guide hole interfaced therewith;

a threaded fastener connected with said clamp body, said threaded fastener having at least one frustoconical taper, said threaded fastener passing through said at least one tapered guide hole, said threaded fastener being orientated parallel to said post seat axis; and an electrical lead connection feature connected to said clamp body;

wherein as said threaded fastener is actuated by being threadably tightened, said at least one frustoconical taper of said threaded fastener engages said at least one tapered guide hole so as to thereby draw closer together said first and second sidewall members in a plane perpendicular to said post seat axis such that said diameter is decreased.

11. An axially actuated battery terminal post clamp, comprising:

a clamp body comprising:

a concave post seat having a diameter, a first end and a second end, wherein said concave post seat defines a post seat axis;

a first sidewall member integrally connected to said first end of said concave post seat; and a second sidewall member integrally connected to said second end of said concave post seat;

wherein at least one of said first and second sidewalls has at least one tapered guide hole interfaced therewith;

a threaded fastener connected with said clamp body, said threaded fastener having at least one frustoconical taper, said threaded fastener passing through said at least one tapered guide hole, said threaded fastener being orientated parallel to said post seat axis; and an electrical lead connection feature connected to said clamp body;

wherein as said threaded fastener is actuated by being threadably tightened, said at least one frustoconical taper of said threaded fastener engages said at least one tapered guide hole so as to thereby draw closer together said first and second sidewall members in a plane perpendicular to said post seat axis such that said diameter is decreased;

further comprising:

a U-shaped first clip and a U-shaped second clip; each of said first and second clips being respectively comprised of an upper lateral clip wall, a lower lateral clip wall, and an end clip wall integrally connected with said upper and lower lateral clip walls; each of said first and second lateral clip walls of said first and second clips having a guide hole; wherein the guide hole of each of said upper and lower lateral clip walls of at least one of said first and second clips is tapered; and a spacer located between said upper and lower lateral clip walls of said first and second clips.

12. The axially actuated battery terminal post clamp of claim 11, wherein said clamp body further comprises a nut receptacle connected with said clamp body; and wherein said threaded fastener comprises:

a bolt comprising a head, a frustoconical bolt taper adjacent said head and a threaded portion; and a nut comprising a main nut body and a frustoconical nut taper, said nut main body being selectively seated at said nut receptacle;

wherein as said threaded fastener is actuated by being threadably tightened, said bolt taper engages said at least one tapered guide hole of at least one of said upper lateral clip walls, and said nut taper engages said at least one tapered guide hole of at least one of said lower lateral clip walls, thereby collectively causing said first and second sidewall members to be drawn closer together in a plane perpendicular to said post seat axis such that said diameter is decreased.

13. The axially actuated battery terminal post clamp of claim 12, further comprising a plurality of teeth formed at said post seat, said teeth having an inward radial orientation.

14. The axially actuated battery terminal post clamp of claim 11, wherein each said guide hole of each of said upper and lower lateral clip walls of first and second clips is tapered.

15. The axially actuated battery terminal post clamp of claim 14, wherein said clamp body further comprises a nut receptacle connected with said clamp body; and wherein said threaded fastener comprises:

a bolt comprising a head, a frustoconical bolt taper adjacent said head and a threaded portion;

a nut comprising a main nut body and a frustoconical nut taper, said nut main body being selectively seated at said nut receptacle; and a spacer located between said upper and lower lateral clip walls of said first and second clips;

wherein as said threaded fastener is actuated by being threadably tightened, said bolt taper engages each said tapered guide hole of each of said upper lateral clip walls, and said nut taper engages said tapered guide hole of each of said lower lateral clip walls, thereby collectively causing said first and second sidewall members to be drawn closer together in a plane perpendicular to said post seat axis such that said diameter is decreased.

16. The axially actuated battery terminal post clamp of claim 15, further comprising a plurality of teeth formed at said post seat, said teeth having an inward radial orientation.

17. An axially actuated battery terminal post clamp, comprising:

a clamp body comprising:

a concave post seat having a diameter, a first end and a second end, wherein said concave post seat defines a post seat axis;

a first sidewall member integrally connected to said first end of said concave post seat; and a second sidewall member integrally connected to said second end of said concave post seat;

a threaded fastener connected with said clamp body, said threaded fastener being orientated parallel to said post seat axis, said threaded fastener comprising:

a bolt comprising a head, a frustoconical bolt taper adjacent said head and a threaded portion; and a nut comprising a main nut body and a frustoconical nut taper, said nut main body being selectively seated at said nut receptacle;

a U-shaped first clip interfaced with said first sidewall member;

a U-shaped second clip interfaced with said second sidewall member, wherein each of said first and second clips respectively comprise an upper lateral clip wall, a lower lateral clip wall, and an end clip wall integrally connected with said upper and lower lateral clip walls; each of said first and second lateral clip walls of said first and second clips having a guide hole; wherein the guide hole of each of said upper and lower lateral clip walls of at least one of said first and second clips is tapered; and wherein said threaded fastener passes through said guide holes;

a spacer located between said upper and lower lateral clip walls of said first and second clips;

an electrical lead connection feature connected to said clamp body; and a plurality of teeth formed at said post seat, said teeth having an inward radial orientation;

wherein as said threaded fastener is actuated by being threadably tightened, said bolt taper engages said at least one tapered hole of at least one of said upper lateral clip walls, and said nut taper engages said at least one tapered hole of at least one of said lower lateral clip walls, thereby collectively causing said first and second sidewall members to be drawn closer together such that said diameter is decreased.

18. The axially actuated battery terminal post clamp of claim 17, wherein each said guide hole of each of said upper and lower lateral clip walls of first and second clips is tapered.

* * * * *